US009353710B2

(12) United States Patent
Meiller

(10) Patent No.: US 9,353,710 B2
(45) Date of Patent: May 31, 2016

(54) CARBON HEATING ELEMENT FOR EVAPORATIVE EMISSION CANISTER

(71) Applicant: DELPHI TECHNOLOGIES, INC., Troy, MI (US)

(72) Inventor: Thomas C. Meiller, Pittsford, NY (US)

(73) Assignee: Delphi Technologies, Inc., Troy, MI (US)

( * ) Notice: Subject to any disclaimer, the term of this patent is extended or adjusted under 35 U.S.C. 154(b) by 776 days.

(21) Appl. No.: 13/709,556

(22) Filed: Dec. 10, 2012

(65) Prior Publication Data

US 2014/0158094 A1 Jun. 12, 2014

(51) Int. Cl.
*F02M 27/00* (2006.01)
*F02M 25/08* (2006.01)

(52) U.S. Cl.
CPC ..... *F02M 27/00* (2013.01); *F02M 25/0854* (2013.01); *F02M 2025/0881* (2013.01); *Y10T 29/49826* (2015.01)

(58) Field of Classification Search
CPC ..... F02M 27/00; F02M 25/0854; F02M 25/0881; Y10T 29/49826
See application file for complete search history.

(56) References Cited

U.S. PATENT DOCUMENTS

| | | | | |
|---|---|---|---|---|
| 4,778,495 | A | 10/1988 | Bishop et al. | |
| 5,632,251 | A * | 5/1997 | Ishikawa | F02M 25/0854 123/519 |
| 5,861,050 | A * | 1/1999 | Pittel | B01D 53/0438 123/519 |
| 6,230,693 | B1 | 5/2001 | Meiller et al. | |
| 6,689,196 | B2 * | 2/2004 | Amano | B01D 53/02 123/519 |
| 6,701,902 | B2 * | 3/2004 | Koyama | F02M 25/08 123/518 |
| 6,896,852 | B1 | 5/2005 | Meiller et al. | |
| 8,839,768 | B2 * | 9/2014 | Kim | F02M 25/0854 123/520 |
| 2011/0167773 | A1 | 7/2011 | Eschlbeck et al. | |
| 2015/0107561 | A1 * | 4/2015 | Makino | F02M 25/0854 123/519 |

* cited by examiner

*Primary Examiner* — Hieu T Vo
*Assistant Examiner* — Sherman Manley
(74) *Attorney, Agent, or Firm* — Joshua M. Haines

(57) ABSTRACT

An evaporative emissions control system for reducing the amount of fuel vapor emitted from a vehicle includes a canister containing a sorbent material and a cartridge heater disposed at least partially within the canister in direct contact with the sorbent material. Electrical terminals for applying power to a heating element within the heater are disposed external to the canister. At least one heat sink may be included within the canister in direct contact with the heater. A method of manufacturing an evaporative emission control system that includes a cartridge heater disposed in a canister is also presented.

14 Claims, 6 Drawing Sheets

CARBON HEATING ELEMENT FOR EVAPORATIVE EMISSION CANISTER

BACKGROUND OF THE INVENTION

Evaporative emissions of fuel vapor from a vehicle having an internal combustion engine occur principally due to venting of the fuel tank of the vehicle. When the vehicle is parked, diurnal changes in temperature or pressure of the ambient atmosphere cause air to waft into and out of the fuel tank. Some of the fuel inevitably evaporates into the air within the tank and thus takes the form of a vapor. If the air emitted from the fuel tank were allowed to flow untreated into the atmosphere, it would inevitably carry with it this fuel vapor. The fuel vapor, however, is a pollutant. For that reason, federal and state governments have imposed increasingly strict regulations over the years governing how much fuel vapor may be emitted from the fuel system of a vehicle.

One approach that automobile manufacturers have long employed to reduce the amount of fuel vapor that a vehicle emits to the atmosphere involves the use of a storage canister. In this approach, a tube, often referred to as a "tank tube," is used to connect the air space in the fuel tank to the storage canister. Inside the storage canister is contained a sorbent material, typically activated carbon, whose properties enable it to adsorb the fuel vapor. Consequently, when air flows out of the tank, the tank tube carries it to the storage canister wherein the fuel vapor is adsorbed into the sorbent material There the fuel vapors are temporarily stored so that they can be burned later in the engine rather than being vented to the atmosphere when the engine is not operating. Due to increasingly stringent air quality standards, improvements are always sought in the art.

BRIEF SUMMARY OF THE INVENTION

In a first aspect of the invention, an evaporative emissions control system for reducing the amount of fuel vapor emitted from a vehicle is presented, where the vehicle has an engine with an air intake passage and a fuel system. The control system includes a canister having a purge port, a tank port, and a vent port in communication with a sorbent material disposed within the canister. The purge port communicates with the intake passage via a purge valve. The tank port communicates with the fuel system and allows a mixture of air and the fuel vapor it carries to be conveyed between the fuel system and the canister. The vent port connects to one end of a vent valve whose other end communicates to atmosphere. The canister has a substantially cylindrical cartridge heater disposed within it such that the heater is disposed in direct physical contact with the sorbent material so as to allow heat conduction from the heater to the sorbent material. During at least one predetermined time interval electrical power is supplied to the heater through electrical terminals located exterior to the canister to heat the sorbent material when the control system is operated in a regenerative phase of operation. During a storage phase of operation, the control system allows of the mixture of air and fuel vapor to flow from the fuel system through the tank port and into the canister. As the mixture flows through the canister, the sorbent material adsorbs a percentage of the fuel vapor. The mixture of air and any unadsorbed fuel vapor then flows through the vent port and through the vent valve to atmosphere. During the regenerative phase, the control system allows air drawn in from atmosphere to flow through the vent valve and the vent port into the canister. As the mixture flows through the canister, fuel vapor is desorbed from the sorbent material. The mixture of air and desorbed fuel vapor is drawn out through the purge port into the intake passage by the engine for combustion within the engine.

In a related aspect, the invention provides a method of manufacturing an evaporative emissions control system. The method includes receiving a canister having a hole defined in an exterior wall of the canister. The method further includes receiving a substantially cylindrical cartridge heater having electrical terminals disposed at or near one end of the heater. The method further includes disposing a heat sink in contact with the cartridge heater and disposing the cartridge heater through the hole in the canister, so that the heat sink is internal to the canister and the electrical terminals are external to the canister.

BRIEF DESCRIPTION OF THE DRAWINGS

The above-mentioned and other features and advantages of this invention will become apparent and be better understood by reference to the following description of embodiments of the invention in conjunction with the accompanying drawings, in which.

DETAILED DESCRIPTION OF THE INVENTION

Figure 1:
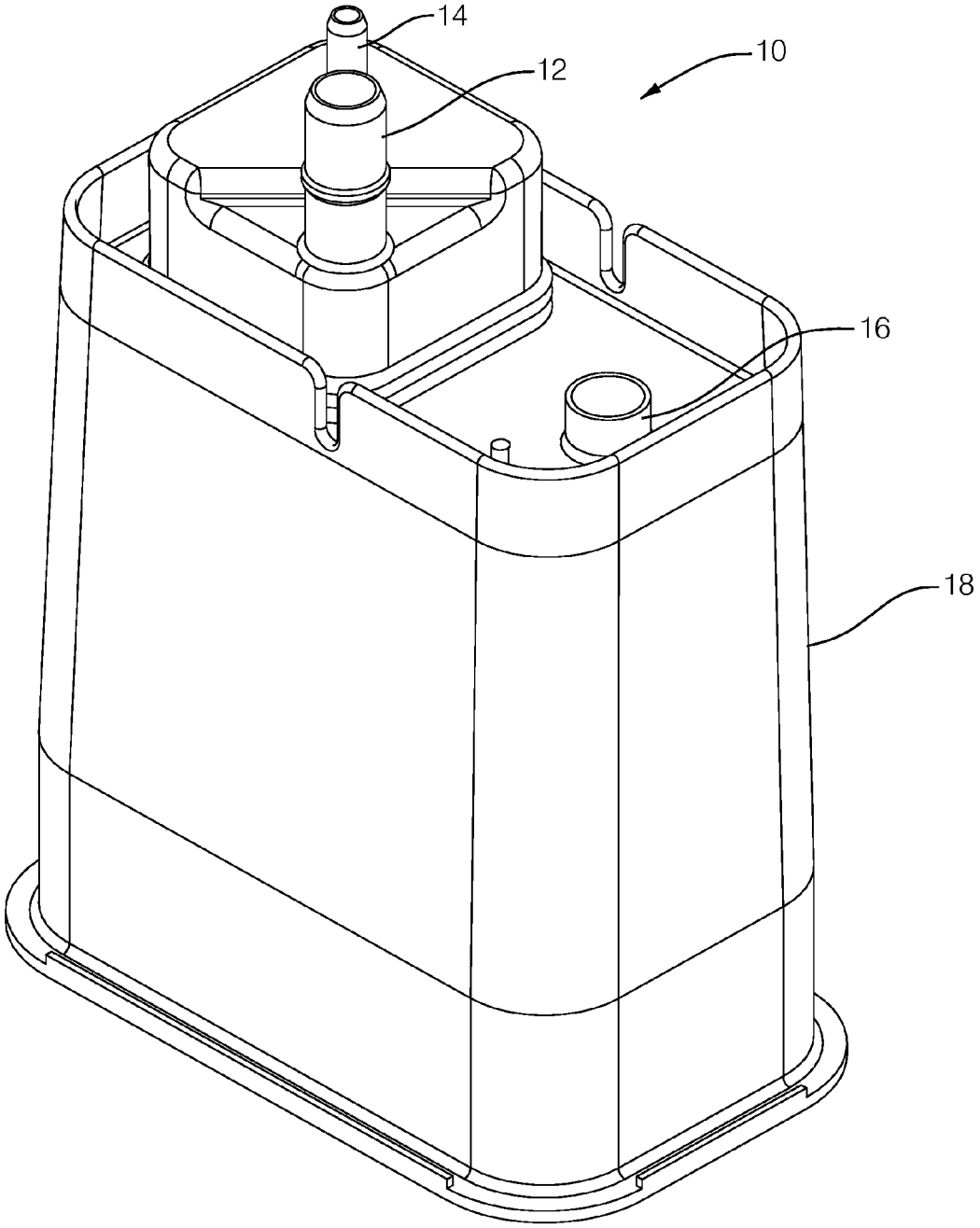
PRIOR ART FIG. 1
FIG. 1 is a perspective view of a prior art storage canister used to reduce emissions of evaporated fuel.
Figure 2:
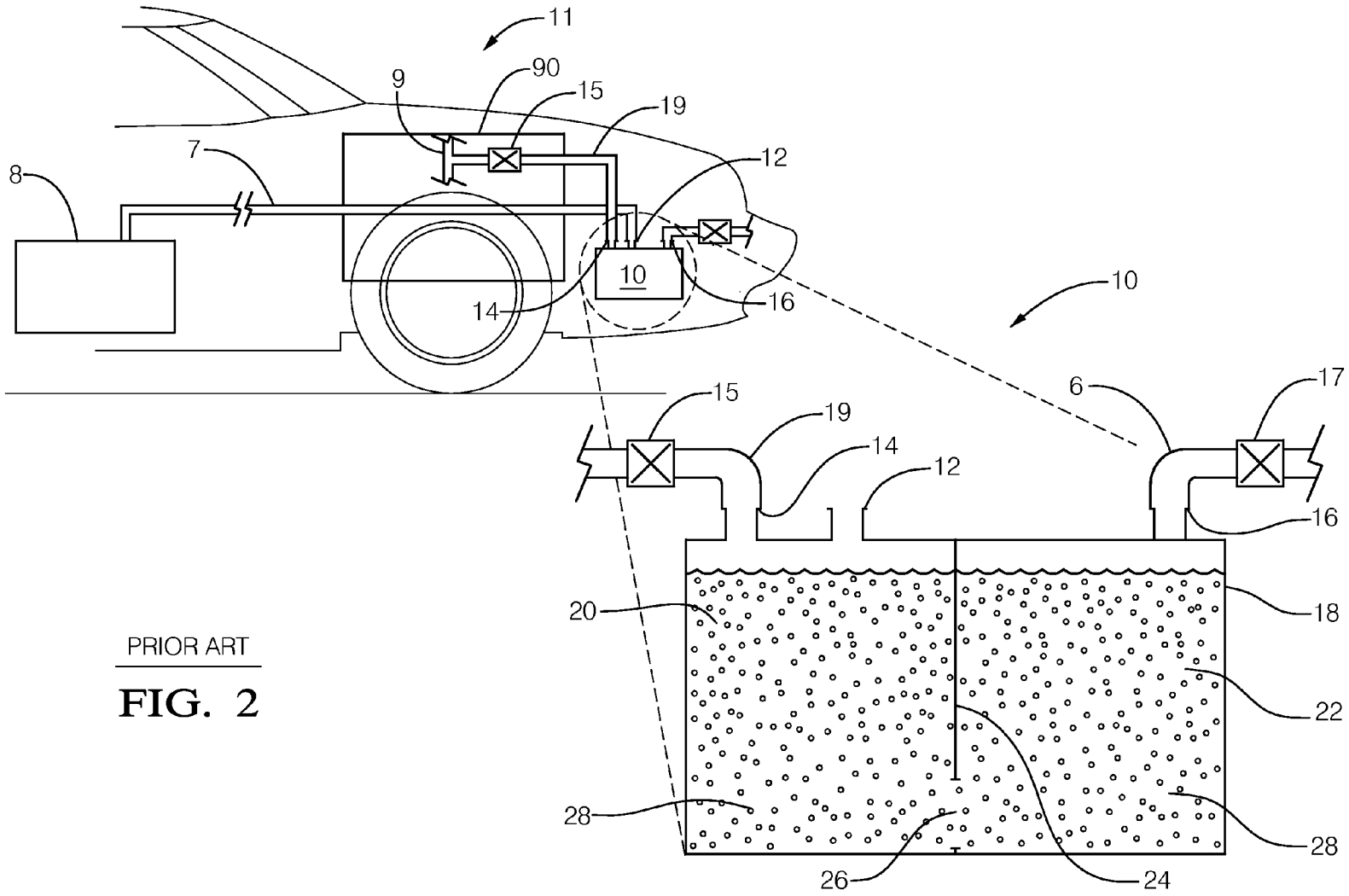
PRIOR ART FIG. 2
FIG. 2 is a schematic depiction showing an evaporative emissions control system that includes the prior art storage canister shown in FIG. 1.

FIGS. 1 and 2 illustrate one type of storage canister, generally designated 10, typically used in the automotive industry. FIG. 1 shows the canister in a perspective view, whereas FIG. 2 shows it in cross-section. The storage canister 10 comprises a container 18 that is partially divided by partition 24 into two compartments 20 and 22. An intercompartmental flow passage 26 connects these compartments.

The storage canister 10 has a tank port 12 and a purge port 14, both of which communicate with the first compartment 20. The tank port 12 connects to the tank tube 7, and thereby allows the air space in the fuel tank 8 to communicate with the first compartment 20. To the left of the tank port 12 as viewed from the perspective of FIG. 2, the purge port 14 connects to a purge line 19. Through a purge valve 15, the purge line 19 connects to the air intake passage 9 of the vehicle 11. (Air flowing into the air intake passage 9 is mixed with fuel, and the mixture eventually drawn into the cylinders for combustion.) The purge valve 15 is closed when the engine is not running. When the engine is running, however, purge valve 15 is opened and thereby allows the storage canister 10 via the first compartment 20 to communicate with the air intake 9.

The storage canister 10 also features a vent port 16 that communicates with the second compartment 22. The vent port 16 connects to a vent line 6. The vent line 6 communicates with the ambient atmosphere through a vent valve 17. Typically controlled via a solenoid, the vent valve 17 is normally held open. When opened, the vent valve 17 allows the storage canister 10 via the second compartment 22, vent port 16 and vent line 6 to communicate with the atmosphere. The vent valve 17 is closed when the storage canister 10 is being tested for leaks.

Evaporative emission control systems of this type essentially have two phases of operation. During the storage phase when the engine is off, the system operates with the purge valve 15 closed and the vent valve 17 opened. When the pressure in the fuel tank 8 is high relative to atmospheric pressure, air from the tank and the fuel vapor it carries flows into tank tube 7 and through tank port 12 into storage canister 10. Inside the storage canister 10, the fuel vapor is adsorbed by the sorbent material 28 as the air that carried it flows not only through the first compartment 20 but also through the second compartment 22 via intercompartmental flow passage 26. Although a high percentage of the fuel vapor is adsorbed into the sorbent material 28, the air as it exits the canister 10 via vent port 16 carries with it some unadsorbed fuel vapor to atmosphere.

During the regenerative phase of operation when the engine 90 is running, the system operates with both the purge valve 15 and the vent valve 17 opened. A vacuum is developed within the intake manifold as a result of the combustion occurring within the cylinders of the engine 90. This vacuum ultimately causes fresh air from the atmosphere to be drawn through vent valve 17 and into the storage canister 10. Specifically, the air is pulled by vacuum through vent port 16, second compartment 22, flow passage 26, first compartment 20 and out purge port 14. Inside the storage canister 10, as the fresh air flows through the sorbent material 28, it strips it of the fuel vapor that it had adsorbed during the previous storage cycle. The sorbent material 28 is thus regenerated for the next storage phase. The purged fuel vapors are carried by the air stream through purge line 19, purge valve 15, air intake passage 9 and to the cylinders where they are consumed as fuel during combustion.

During the storage phase, the fuel vapors previously adsorbed by the sorbent material 28 may also return to the fuel tank 8 when the pressure in the tank lowers relative to atmospheric pressure. This occurs when the temperature inside the fuel tank 8 drops and the fuel vapors condense. Being normally open, the vent valve 17 under such conditions allows air into the storage canister 10 and relieves any vacuum.

The regeneration process may be aided by providing heat to the sorbent material in the canister, thereby enabling the sorbent material to more readily release the adsorbed fuel vapor. Systems that heat the air entering the vent port of a canister and/or the sorbent material in a canister have been described, for example in U.S. Pat. No. 6,230,693, the entire disclosure of which is hereby incorporated by reference.

Figure 3:
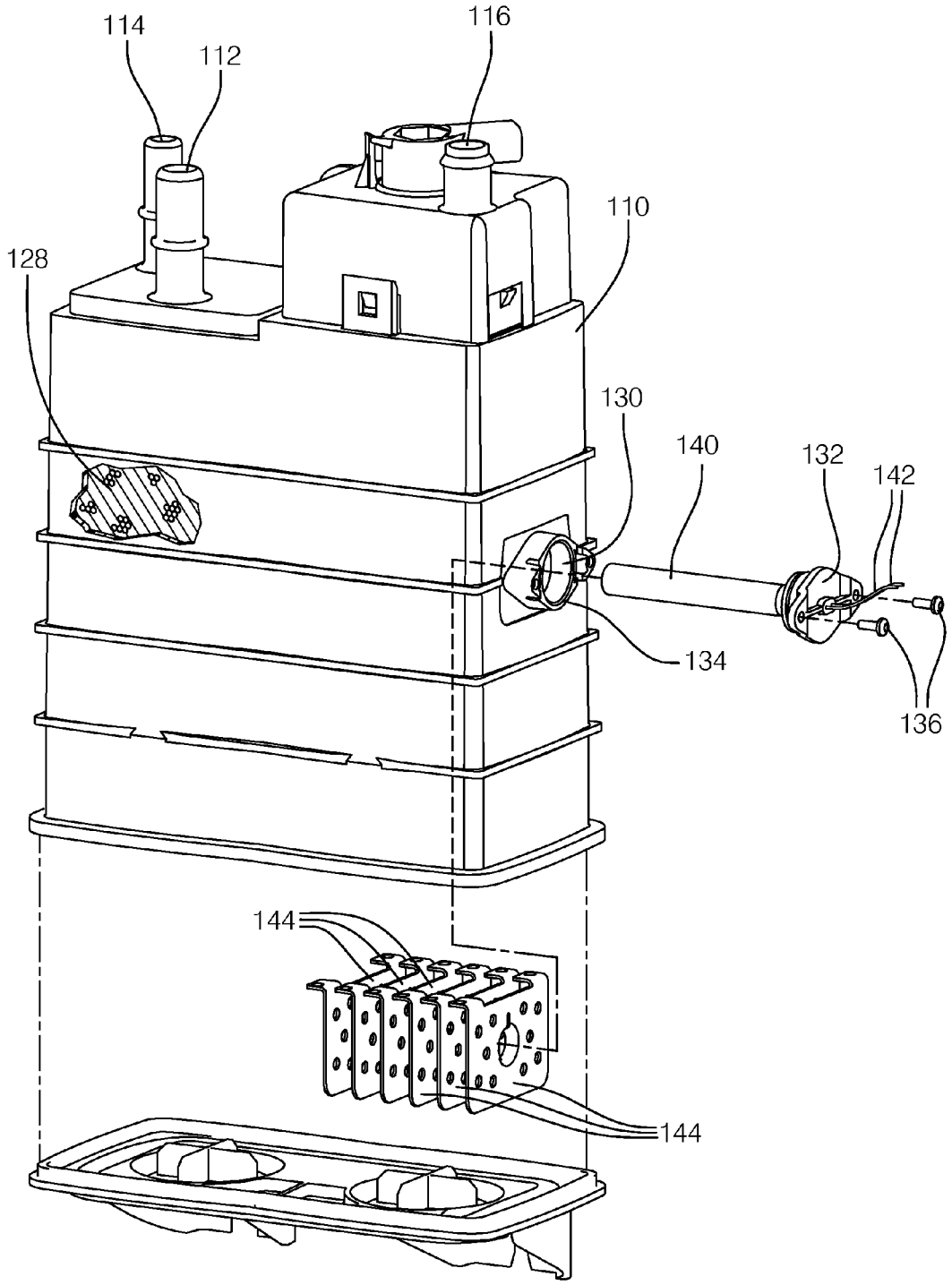
FIG. 3 is an exploded view depicting aspects of the present invention.
Figure 4:
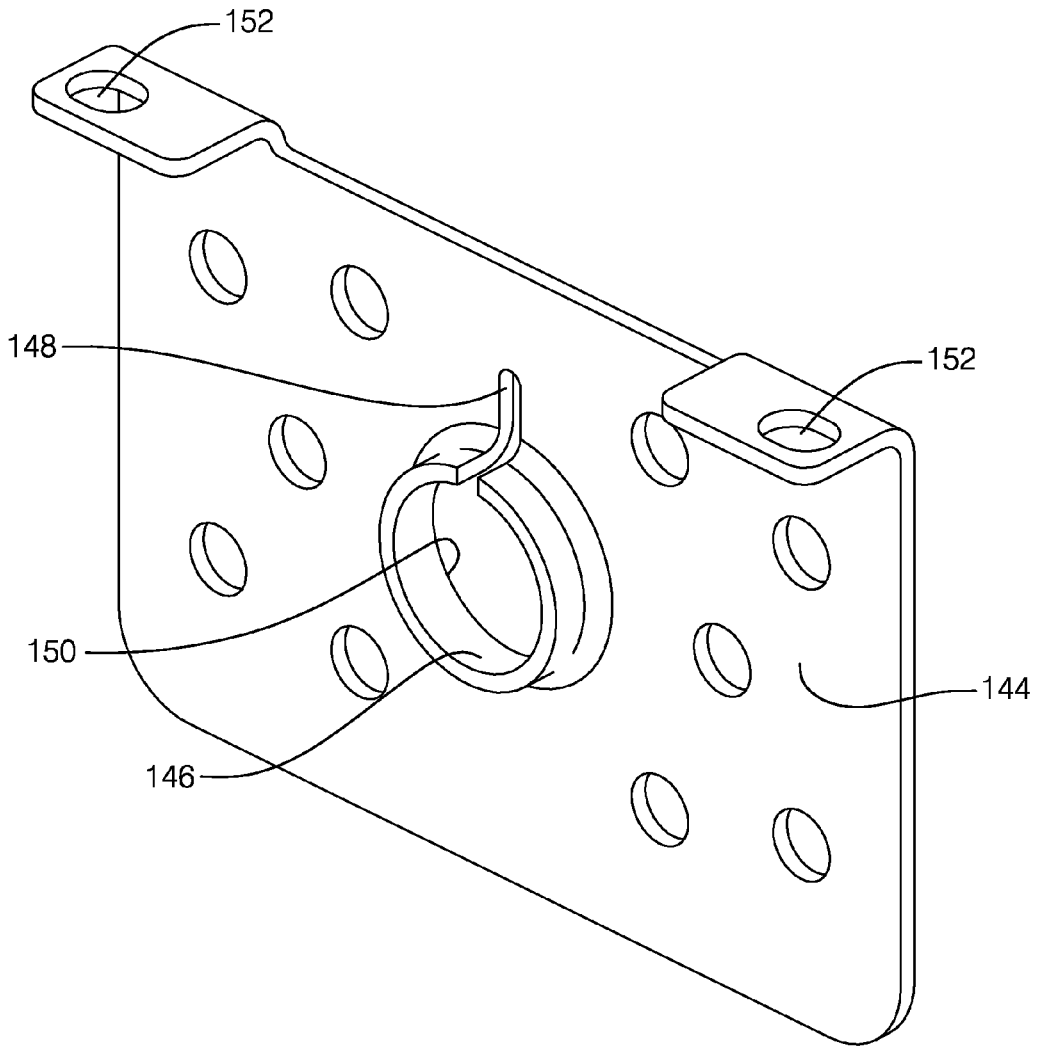
FIG. 4 is a view of a heat sink fin employed in an embodiment of the invention.
Figure 5:
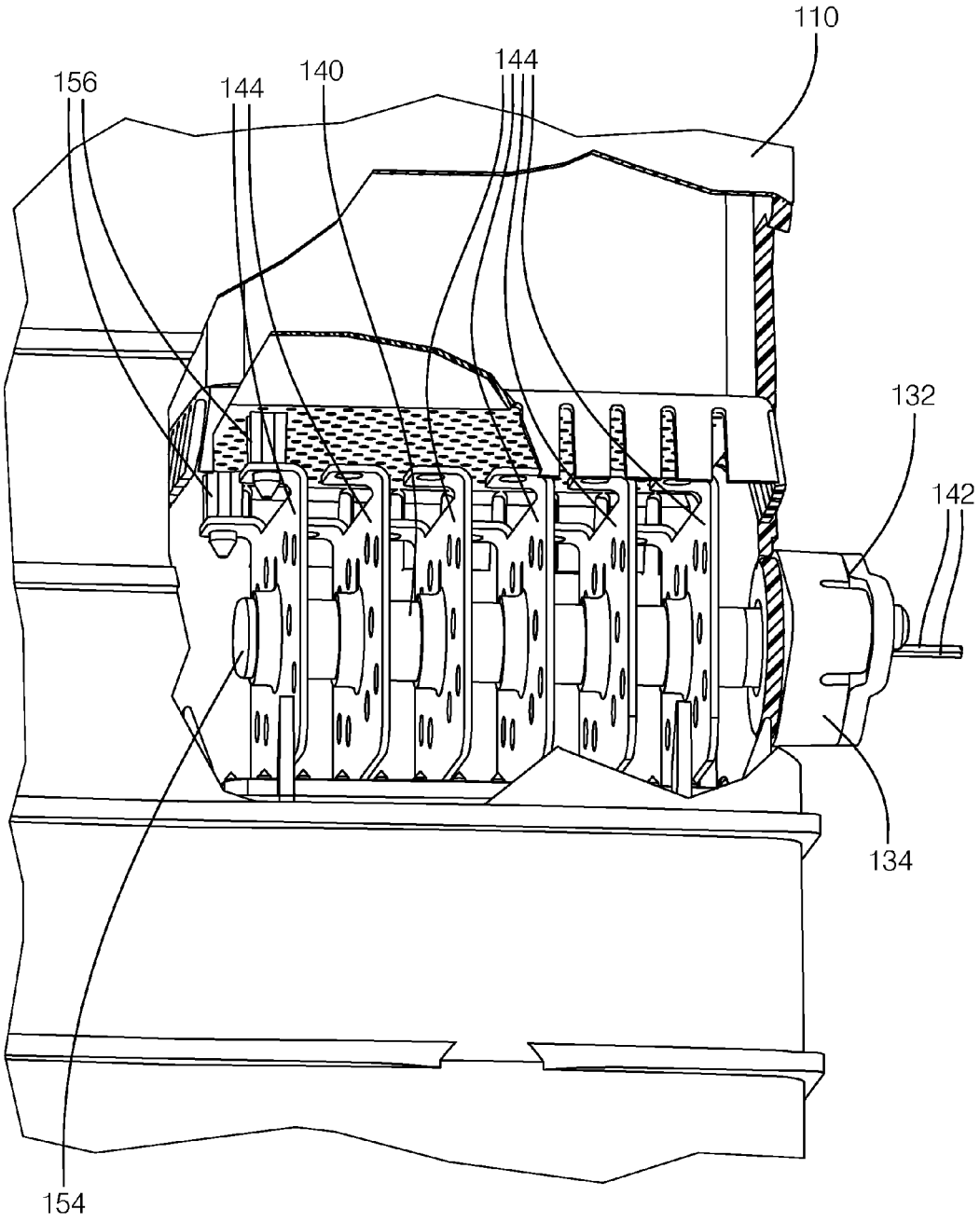
FIG. 5 is a cutaway view depicting aspects of the invention.

Referring to FIG. 3 through FIG. 5, the present invention provides a canister 110 having a purge port 114, a tank port 112, and a vent port 116 in communication with a sorbent material 128 distributed within the canister. The purge port 114, the tank port 112, and the vent port 116 may communicate with vehicle systems and with atmosphere in a manner as described earlier with respect to the purge port 14, tank port 12, and vent port 16 of FIGS. 1 and 2.

As depicted in the exploded view of FIG. 3 and the cutaway view of FIG. 5, the canister 110 has a cartridge heater 140 disposed within the canister 110 through a hole 130 defined in the canister 110. As used herein, the term "cartridge heater" is taken to mean a heater that comprises an electrically powered heating element contained within a substantially tubular sheath, with electrical connections to the heating element made at one end of the sheath. While the cartridge heater 140 is depicted herein as having a substantially cylindrical sheath, it will be appreciated that other cross-sectional shapes for the sheath including oval or substantially polygonal may be used without departing from the present invention. The canister 110 is shown with a mounting boss 134 surrounding the hole 130 in the embodiment of FIGS. 3 and 5.

The cartridge heater 140 shown in the Figures includes a flange 132 to facilitate mounting the cartridge heater 140 to the mounting boss 134 on the canister 110 and sealing the interface between the cartridge heater 140 and the canister 110. The flange 132 is shown being affixed to the mounting boss 134 by fasteners 136, but it will be appreciated that other means of affixing the cartridge heater 140 to the canister 110 may be employed, including but not limited to snap fit, bayonet mount, or adhesives. Sealing the interface between the cartridge heater 140 and the canister 110 may be accomplished by any of a number of known means including but not limited to an O-ring seal, a separate gasket, a form-in-place gasket, and the like. As shown in FIG. 5, the cartridge heater 140 is disposed in the canister 110 such that the electrical connections 142 are accessible external to the canister 110. The heating element disposed within the sheath of the cartridge heater 140 comprises an electrical resistance that releases heat due to power dissipation resulting from the application of a voltage to the heating element. The heating element may, for example, be formed as a wire coil or as one or more ceramic elements. It is particularly advantageous for the heating element to have a Positive Temperature Coefficient (PTC) characteristic in which the electrical resistance increases as the temperature of the heating element increases.

With continued reference to FIG. 3, the cartridge heater 140 is disposed in direct physical contact with a portion of the sorbent material 128 so as to allow heat conduction from the heater 140 to the sorbent material 128. When the control system is operated in a regenerative phase of operation, electrical power is supplied to the heater 140 through the electrical terminals 142 located external to the canister 110 to heat the sorbent material 128.

In an embodiment of the invention as shown in FIG. 3 and FIG. 5, one or more heat sinks 144 are disposed within the canister 110 in contact with the heater 140. The heat sinks 144 serve to aid in heat transfer from the heater 140, both conductive heat transfer to a portion of the sorbent material 128 that is in direct contact with a heat sink 144 and convective heat transfer to the mixture of air and desorbed fuel vapor flowing through the canister 110. A suitable heat sink 144 is shown in FIG. 4. With reference to FIG. 4, the heat sink 144 defines a first opening 146 that is configured to receive the heater 140. The heat sink 144 may be assembled to the heater 140 by press fitting the heater 140 through the opening 146 in the heat sink 144. The heat sink 144 may further define a slot 148 extending from the opening 146 to facilitate assembly of the heat sink 144 to the heater 140. The opening 146 in the heat sink 144 may further be provided with a radius or chamfer lead-in 150 to facilitate positioning the heater 140 relative to the opening 146 during assembly.

The heat sink 144 may also be provided with a second opening 152, the purpose of which will be recognized with reference to FIG. 5. With the cartridge heater 140 supported in a cantilever fashion only at the interface between the flange 132 and the mounting boss 134 on the canister 110 at the hole 130, the end 154 of the cartridge heater 140 internal to the canister 110 and furthest from the flange 132 may be prone to movement due to vibrational loads induced on the canister 110 by its mounting environment. Such movement may damage the structure of the portion of sorbent material 128 in the vicinity of the heater 140 and/or in the vicinity of the heat sinks 144, and/or may damage the heater 140 and/or the canister 110 in the vicinity of the flange 132. To restrict movement of the heater 140 and heat sinks 144, a feature may be provided in the interior of the canister 110 to restrict relative motion between the end 154 of the heater 140 and the canister 110. FIG. 5 depicts this feature as a post 156 disposed so as to interface with the second opening 152 of a heat sink 144. In a preferred embodiment, the second opening 152 of a heat sink 144 is placed over a post 156, and the end of the post 156 passing through the second opening 152 is deformed such as through heat staking to fix the location of the heat sink 144 relative to the post 156.

In a related aspect of the invention, a method is provided to manufacture an evaporative emissions control system. The method may be understood with reference to the exploded view in FIG. 3. The method includes the steps of receiving a canister 110 that has a hole 130 defined in a wall of the canister 110. The method further includes the step of receiving a cartridge heater 140 that has electrical terminals 142 disposed at one end of the cartridge heater 140. The method further includes disposing at least one heat sink 144 internal to the canister and in contact with the cartridge heater 140 such that the electrical terminals 142 are external to the canister 110.

In an aspect of the method, the step of disposing at least one heat sink 144 in contact with the cartridge heater 140 includes inserting the cartridge heater 140 through a first opening 146 defined in the heat sink 144. In an advantageous embodiment of the method, the heater 140 and the heat sink 144 are configured so as to result in a press fit between the heater 140 and the heat sink 144.

Figure 6:
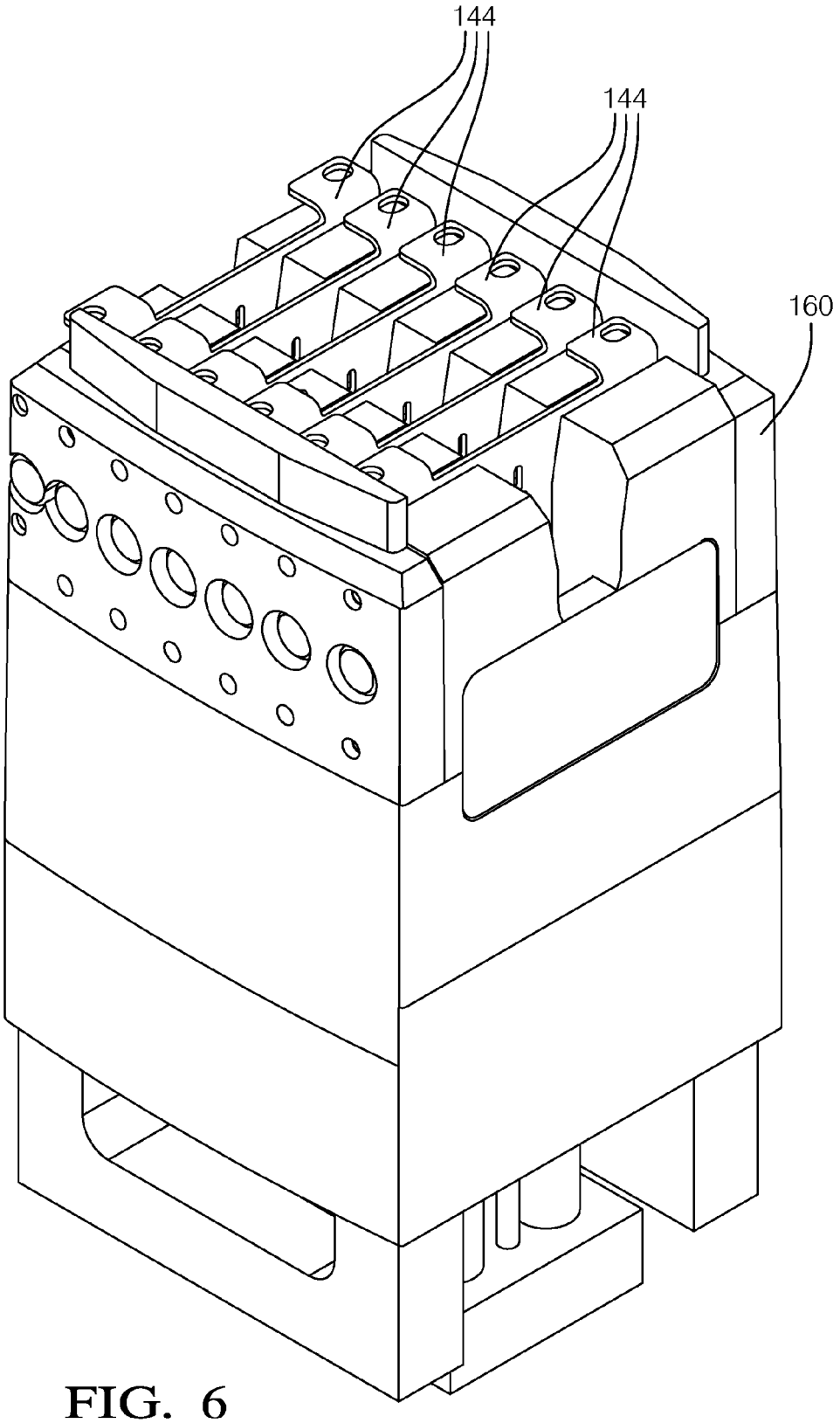
FIG. 6 is a depiction of a plurality of heat sink fins in a fixture.

In a further aspect of the invention, one or more heat sinks 144 may be located in a fixture that is configured to support the one or more heat sinks 144 in a desired position while the heater 140 is inserted through openings 146 defined in the one or more heat sinks 144. FIG. 6 depicts such a fixture 160 holding a plurality of heat sinks 144 prior to assembly of the heat sinks 144 to the cartridge heater 140.

In a further aspect of the invention, the method may include locating a second opening 152 defined in the heat sink 144 so as to substantially surround a feature 156 defined internal to the canister 110. A portion of the feature 156 may subsequently be deformed to prevent relative movement between the heat sink 144 and the canister 110.

While the invention has been described in terms of specific embodiments, the present invention can be further modified within the spirit and scope of this disclosure. This application is intended to cover any variations, uses, or adaptations of the present invention using the general principles disclosed herein. Further, this application is intended to cover such departures from the present disclosure as come within the known or customary practice in the art to which this invention pertains and which fall within the limits of the claims which follow.

I claim:

1. An evaporative emissions control system for reducing the amount of fuel vapor emitted from a vehicle, said vehicle having an engine with an air intake passage and a fuel system, said control system comprising:

a canister having a purge port, a tank port, and a vent port in communication with a sorbent material disposed within said canister, said purge port configured to communicate with said air intake passage via a purge valve, said tank port configured to convey a mixture of air and said fuel vapor between said fuel system and said canister, and said vent port configured to communicate with atmosphere through a vent valve;

a cartridge heater at least partially disposed within said canister, wherein said heater is disposed in direct physical contact with said sorbent material so as to allow heat conduction from said heater to said sorbent material; and a heat sink in direct physical contact with the heater and disposed within said canister, wherein electrical power is conveyed from said vehicle to said heater through electrical terminals extending from said heater and disposed external to said canister during at least one predetermined time interval to heat said sorbent material when said control system is operated in a regenerative phase of operation; such that said control system:

(a) during a storage phase of operation, allows flow of said mixture from said fuel system through said tank port into said canister wherein said sorbent material adsorbs a percentage of said fuel vapor then through said vent port and said vent valve to atmosphere, and (b) during said regenerative phase, allows air drawn in from atmosphere to flow through said vent valve and said vent port into said canister to desorb said fuel vapor from said sorbent material, with said desorbed fuel vapor then being drawn out through said purge port into said air intake passage by said engine.

2. The evaporative emissions control system of claim 1 wherein the heater is inserted through a first opening defined in the heat sink.

3. The evaporative emissions control system of claim 2 wherein the heater and the heat sink are configured such that the fit between the heat sink and the heater is a press fit.

4. The evaporative emissions control system of claim 1 wherein a portion of said heat sink is affixed to an attachment feature defined in the interior of the canister.

5. The evaporative emissions control system of claim 4, wherein the attachment feature is a post, wherein a second opening is defined in said portion of said heat sink, and wherein a portion of the post is deformed after being passed through the second opening.

6. The evaporative emissions control system of claim 1 wherein the heat sink is in direct physical contact with the sorbent material.

7. A method of manufacturing an evaporative emissions control system comprising the steps of:

receiving a canister having a hole defined in a wall thereof;

receiving a cartridge heater having electrical terminals disposed proximate one end thereof;

disposing the cartridge heater through the hole in the canister; and disposing a heat sink in contact with the cartridge heater;

wherein the heat sink is internal to the canister and the electrical terminals are external to the canister.

8. The method of claim 7 wherein a fluidtight seal between the interior of the canister and the exterior of the canister is formed around the cartridge heater.

9. The method of claim 7 wherein the step of disposing a heat sink in contact with the cartridge heater comprises inserting the cartridge heater through a first opening defined in the heat sink.

10. The method of claim 9 wherein the heat sink and the cartridge heater are configured such that the fit between the heat sink and the cartridge heater is a press fit.

11. The method of claim 7 further comprising the step of locating the heat sink in a fixture before disposing the heat sink in contact with the cartridge heater.

12. The method of claim 7 further comprising the step of affixing the heat sink to an attachment feature defined internal to the canister.

13. The method of claim 12, wherein the step of affixing the heat sink to an attachment feature comprises passing a portion of the attachment feature through a second opening defined in the heat sink.

14. The method of claim 13 further comprising deforming the portion of the attachment feature that is passed through the second opening defined in the heat sink.

* * * * *